US006571585B1

(12) United States Patent
Wasinger

(10) Patent No.: US 6,571,585 B1
(45) Date of Patent: Jun. 3, 2003

(54) APPARATUS FOR TREATMENT OF DYED GARMENTS AND FABRICS WITH OXIDIZING GASES

(76) Inventor: Eric Wasinger, 7977 Garden North Dr., San Antonio, TX (US) 78266-1714

( * ) Notice: Subject to any disclaimer, the term of this patent is extended or adjusted under 35 U.S.C. 154(b) by 0 days.

(21) Appl. No.: 09/437,866

(22) Filed: Nov. 1, 1999

(51) Int. Cl.[7] ..... D06F 35/00

(52) U.S. Cl. ..... 68/5 C; 68/13 R; 68/183; 68/207; 68/902

(58) Field of Search ..... 68/13 R, 18 R, 68/183, 207, 902, 56, 5 D; 8/158, 149.1, 149.3

(56) References Cited

U.S. PATENT DOCUMENTS 3,966,542 A * 6/1976 Oldshue
4,123,317 A * 10/1978 Fritzvold et al.
4,214,330 A * 7/1980 Thorsen
5,118,322 A * 6/1992 Wasinger et al.
5,181,399 A * 1/1993 Engel et al.
5,241,720 A * 9/1993 Engel et al.
5,261,925 A * 11/1993 Wasinger et al.
5,313,811 A * 5/1994 Wasinger et al.
5,366,510 A * 11/1994 Wasinger et al.
5,376,143 A * 12/1994 Wasinger et al.
5,404,732 A * 4/1995 Kim
5,407,446 A * 4/1995 Sando et al.
5,471,692 A * 12/1995 Wasinger et al.
5,488,842 A * 2/1996 Nishioka et al.
5,493,743 A * 2/1996 Schneider et al.
5,611,816 A * 3/1997 Wasinger
5,613,983 A * 3/1997 Terry et al.
5,625,915 A * 5/1997 Radler et al.
5,645,608 A * 7/1997 Cooper et al.
5,806,120 A * 9/1998 McEachern
5,939,030 A * 8/1999 Moxley et al.
5,940,988 A * 8/1999 Eisen
5,960,649 A * 10/1999 Burdick
6,085,556 A * 7/2000 Moon

* cited by examiner

*Primary Examiner*—Frankie L. Stinson
(74) *Attorney, Agent, or Firm*—John Lez

(57) ABSTRACT

There is provided an apparatus for treating garments and fabrics in a dry or wetted state or in an aqueous liquid. The apparatus has an apertured rotating barrel which hold the garments or fabric. A microprocess in association with a plurality of valves selectively admits oxidizing gas, or, steam and liquid into the barrel to desize and/or discolor the garments or fabrics.

9 Claims, 2 Drawing Sheets

APPARATUS FOR TREATMENT OF DYED GARMENTS AND FABRICS WITH OXIDIZING GASES

FELD OF THE INVENTION

This invention relates to an apparatus for the treatment of fabrics with oxidizing gases. More particularly, there is provided an apparatus for treating fabrics in an extraction stage of a laundering operation with oxidizing gases such as ozone so as to decolorize dyes or coloring agents on the fabrics. The fabrics can be dry, wetted or in aqueous liquid.

BACKGROUND OF THE INVENTION

The present invention is an improvement over the apparatus disclosed in U.S. Pat. No. 5,313,811, which is herein unincorporated by reference. The prior art apparatus requires a venturi system for introducing oxidizing gases into the processing vessel. Consequently, sufficient water must be present in order that a pump can push the water throughout the system, generate a vacuum and draw the oxidizing gas into the return pipe where it is blended with water and returned to the processing vessel.

In the cases where a desizing or abrasion step is run before or in conjunction with the oxidation, large amounts of dye are suspended in the water to operate the venturi. Therefore, the oxidizing agent attacks the dye in the return line between the venturi and the processing vessel. This occurrence decreases the efficiency in desizing and decolorizing garments or fabrics and increases the requirement for more oxidizing agent. Additionally, flowing water is required so that decolorization cannot be provided for dry or wetted garments.

Various other systems have been developed to treat fabric or garments with ozone. The systems generally use steam mixed with ozone enriched air or oxygen and the fabric or garments are suspended in a treatment chamber. The steam has the function of wetting the fabric or garments and to elevate the temperature to increase the reaction rate.

U.S. Pat. No. 1,823,352 to Crespi et al discloses an apparatus for bleaching textile fibers with a gaseous current, such as ozonized air. In the apparatus, textile material is suspended in a chamber where it is acted on by a gaseous ozonized air mixture which passes through the chamber.

U.S. Pat. No. 4,283,251 to Singh discloses a process relating to the ozone and peroxygen bleaching of cellulosic pulp. The process includes the steps of recycling extract effluent from the bleaching treatment.

U.S. Pat. No. 4,300,367 to Thorsen discloses the treatment of fibers with ozone—steam mixtures by conveying them through an open-ended chamber. The fibers are exposed to the ozone—steam mixture in the horizontal middle section of the chamber where the ozone is centrally introduced.

U.S. patent application Ser. No. 460,357 of Hall et al, which is herein incorporated by reference, discloses the fading of dyed cellulosic garments by the ozone degradation of the dye without any substantial degradation of the cellulosic materials in a vapor phase.

It should be understood that the term "dye" as used herein is meant to include any of the materials which are used to provide a color to a fabric such as conventional dyes, pigments, or the like. The term "fabric" as used herein is meant to include woven and non-woven cloth, knitted fabrics, garments, and the like.

A dry fabric or garment can contain up to about 5% moisture depending on atmospheric conditions.

SUMMARY OF THE INVENTION

In accordance with the invention there is provided a multi-purpose apparatus for laundering and selectively decolorizing a fabric, especially those containing cellulosic material having an oxidizable coloring agent such as a dye, pigment, organic or inorganic residues, and the like in a dry or wetted state or in a liquid. The fabric may comprise cotton, linen, or other bast fibers or rayon alone or in combination with other materials including natural and synthetic fibers, for example, wool, nylon, polyester, and the like.

The invention provides an apparatus for laundering and treating garments or fabrics with an oxidizing agent. The apparatus includes a housing having a chamber. The chamber contains a barrel or drum mounted for rotation in the chamber with means for rotating the barrel. Door means is provided on said housing for placing garments or fabrics into the chamber. Means is provided for introducing the oxidizing agent, which is a gas into the chamber. Pipe means associated with the chamber permits circulating the oxidizing gas into the chamber when required. There are means associated with the housing for introducing an aqueous fluid into the chamber and means for removing liquid from the chamber if required. The apparatus advantageously contains a microprocessor for selectively controlling the laundering cycles including washing, extracting, desizing, etc. with valves.

Advantageously, the oxidizing gas is introduced into the chamber through the door means.

The apparatus of the invention can be used to decolorize garments or fabrics having an oxidizable coloring agent by either placing an oxidizing gas in a liquid or treating the fabrics or garments with an oxidizing agent in a gaseous or vapor phase or both.

The apparatus is further capable of undergoing various laundering operations before or after treatment with an oxidizing agent, for example, desizing, extracting, washing and abrading.

The oxidizing agent can be gaseous or a liquid or a solid oxidant in a vapor state. Gaseous oxidizing agents include ozone, NOx and SOx. These gases can be used alone, in admixture or diluted with an inert or low reactive gas such as air. The oxidizing gases can be used in combination with steam or in an aqueous system.

The non-gaseous oxidants should be used in a vapor phase, preferably with wetted fabrics. More preferably, the non-gaseous oxidants are used in combination with steam.

The oxidant, for example, ozone primarily reacts with the colorant on the fabric when the fabric is wet. Therefore, the garment is wetted or treated in a wet state. The water content of the wetted fabric when treated is about 5 to 75% by weight, more preferably about 20 to 40% by weight or higher depending upon the degree of treatment, the type of oxidant and the effect desired. The process is performed in a chamber in which the oxidant is generally present in an amount of about 10 to 1000 mg. per liter, more preferably about 10 to 100 mg per liter. The temperature in the chamber of about 40 to 100 degrees C. Any excess oxidant emitted may be recycled back into the chamber or used to treat any effluent of the laundering process.

It is an object of the invention to provide an apparatus for use in a laundering operation to decolorize dyed garments or fabrics with an oxidant without degrading the fabric.

It is still further object of the invention to provide an apparatus for selectively and/or evenly decolorizing or fading dyed garments to produce fashion garments.

It is another object of the invention to provide an apparatus for use in a laundering operation which can desize, wash, extract and provide an oxidant to decolorize a colorant of a fabric or garment in a single chamber.

It is yet another object of the invention to provide an apparatus for decolorizing fabrics and garment where flowing water is not required.

Other objects and a fuller understanding of the invention will be had by referring to the following description and claims of a preferred embodiment, taken in conjunction with the accompanying drawings.

DESCRIPTION OF THE PREFERRED EMBODIMENTS

Figure 1:
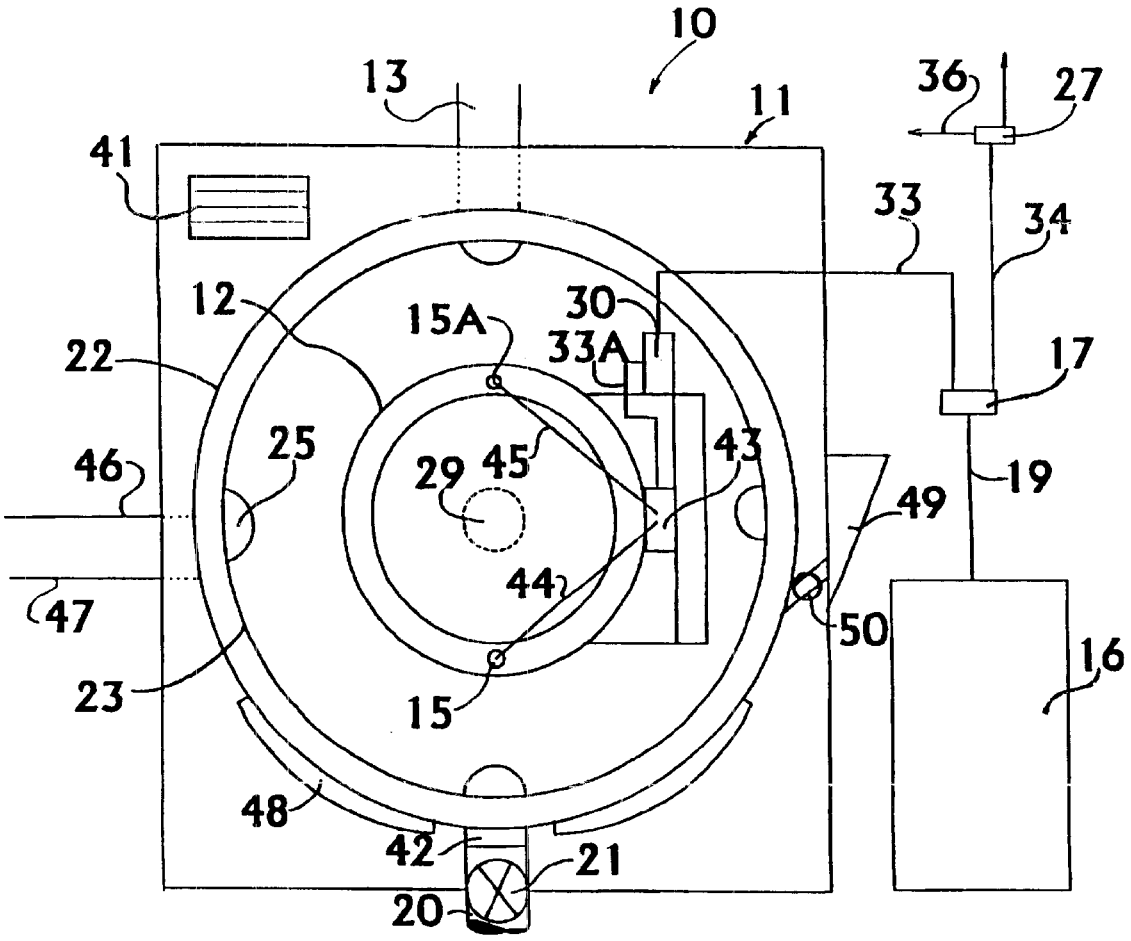
FIG. 1 is an isometric cross-sectional view of the apparatus of the invention.

Although specific terms are used in the following description for the sake of clarity, these terms are intended to refer only to the particular structure of the invention selected for illustration in the drawings and are not intended to define or limit the scope of the invention.

The apparatus of the invention will be next described in detail with reference to the annexed drawings. In the description that follows, the apparatus will be described particularly for use in connection with an oxidizing gas which is ozone. However, it should be understood that other types of oxidants may be utilized in the liquid as well as the vapor phase to decolorize the coloring agent present, particularly an oxidizable dye. Other suitable oxidants include chlorine, nitrous oxides and/or sulfur oxides.

Figure 2:
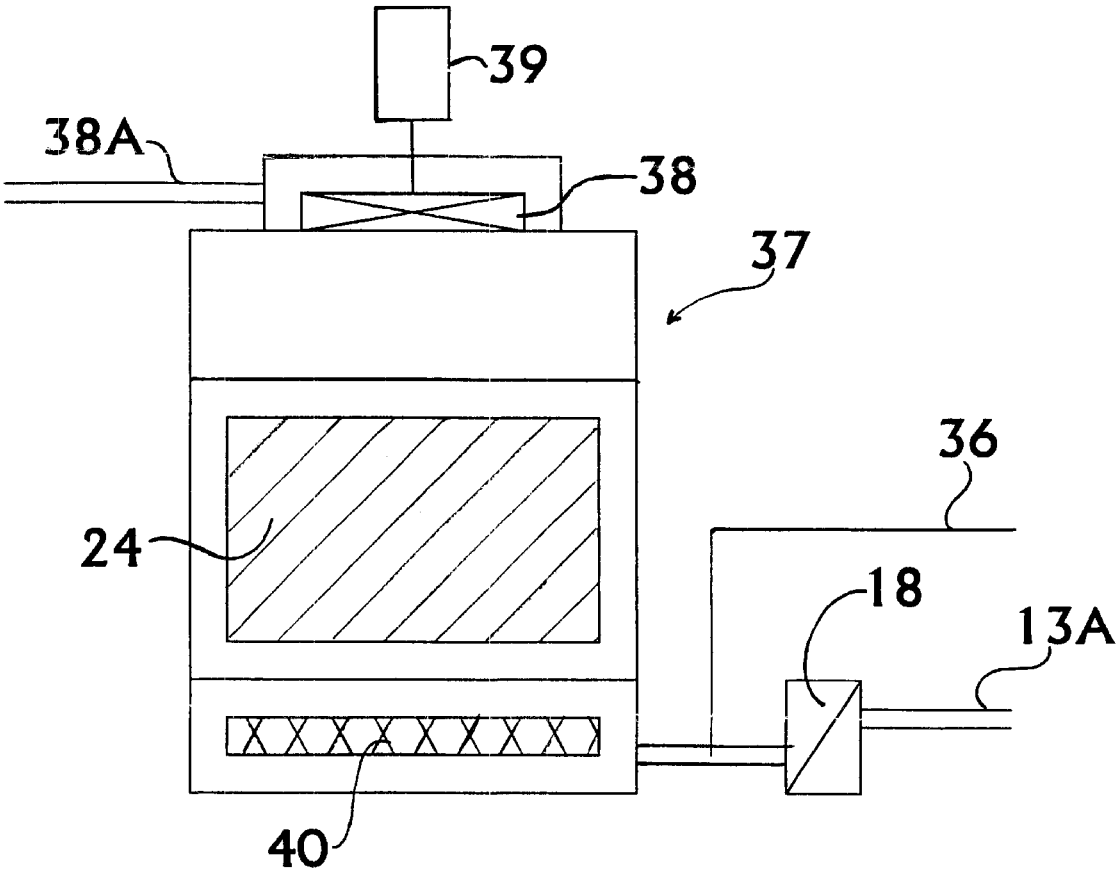
FIG. 2 is a front elevational view of a gas destruct apparatus of the invention.

As seen in FIGS. 1 and 2, an apparatus 10 of the invention includes a housing 11 having an ozone-resistant treatment chamber 22. In the chamber 22 is an apertured drum or barrel 23which is mounted on a shaft for rotation by a motor (not shown). The motor is preferably a variable speed motor with reverse capabilities. The variable speed motor allows a tumbling and extracting cycle. A gas-tight door 12 permits placement of garments or fabrics into the chamber. A door with a glass porthole is preferred so as to allow for inspection of the degree of decolorization of the fabric or garments. The door preferably is provided with at least on gas entry port 15.

Associated with the chamber 22 is a hose with a valve 50 which is closed when a gas is present in the chamber.

Preferably, the barrel 23 is provided along its interior with structural ribs 25 to make the barrel rigid and provide a mechanism to aid in the tumbling of garments or fabric. The ribs 25 also aid in abrading of fabric or garments. The ribs 25 can function to abrade the fabric or garments to provide a fashion appearance to the fabric or garments. The ribs 25, during a desize cycle assists in removing sizing in combination with an enzyme or ozone as the desizing agent. The ribs 25 also act as a tumbler during a washing cycle. Abrading means comprising roughening material such as abrasion panels may be provided on the ribs 25, pumice stone or aluminum diamond plates may be used.

At the lower portion of the chamber 22 is a drain 42 to remove liquid from the chamber 22. Associated with drain is a pipe 20 having a valve 21 for discharging liquid when it is opened and causing liquid to remain in the chamber 22 when closed. Water lines 46, 47 bring in hot or cold water into the chamber, as required.

At the upper portion of the chamber 22 is a vent pipe 13, which allows oxidizing gas to escape at a controlled rate. Vent pipe 13 allows the oxidizing gas to flow to a flow control valve 18. The flow control valve 18 remains in the normally open position until it receives a signal from a micro processor 41 that the apparatus is receiving oxidizing gases into the chamber 22. At such time the flow control valve 18 closes to a predetermined setting to allow oxidizing gases to remain in the chamber 22 under greater concentration or under pressure. An additional vent pipe 13A is used between the flow control valve 18 and an oxidizing gas destruction unit 37.

The oxidizing gas destruction unit 37 consists of an oxidizing gas resistant material. It contains a heating element 40 usually located in the bottom of the unit. Above the heating element 40 is a bed 24 of various types of charcoal particles which aid in the destruction of the oxidizing gases. The oxidizing gas destruction unit 37 also contains a fan 38 which is powered by an electric motor 39. The fan 38 and electric motor 39 provide a means to maintain a vacuum in the vessel 22. This vacuum produced by the fan 38 and the electric motor 39 pulls the unexpended oxidizing gases through the destruction unit 37 thereby destroying any oxidizing gases prior to discharge through exhaust 38A into the atmosphere.

The oxidizing gas destruction unit 37 is also utilized after the oxidizing gas cycle. In that after the oxidizing gas cycle, the chamber 22 must be purged of any remaining oxidizing gases. After the oxidation cycle, a signal is sent from the microprocessor 41 to the flow control valve 18 to open. At the same time the microprocessor 41 also sends a signal to the drain valve 21 to open, thus allowing air to free-flow through the oxidizing gas destruction unit 37.

The apparatus also includes a 3-way valve 17 for the introduction of oxidizing gases. In FIG. 1, an ozone generator 16 is used as the source of the oxidizing gas. The ozone gas under pressure moves from the generator 16 through ozone resistant piping 19 to the 3-way valve 17. During the oxidizing step, the micro processor 41 sends a signal to the electrically or air operated 3-way valve 17 to open, allowing the ozone to flow through ozone resistant piping 33, then through an ozone resistant swivel fitting 30. The ozone resistant swivel fitting 30 is used to allow all of the piping 33A to a second 3-way valve 43. The 3-way valve 43 is used to determine the flow direction of the ozone from this point forward. In position "a" the 3-way valve 43 opens to allow the ozone gas to flow through ozone resistant piping 44, through port 15 located at the lower part of the door 12 into process chamber 22. The port 15 may consist of one or a multiple of port openings. In position "b" the 3-way valve 43 opens in the opposite direction to allow the ozone gas to flow through ozone resistant piping 45, through port 15A located at the upper part of the door 12 into process chamber 22. The port 15A may consist of one or a multiple of port openings.

The 3-way valve 17 in the normal position (not receiving a signal from the micro processor 41 allows the ozone to travel through the ozone resistant piping 34 to an additional 3-way valve 27. The ozone may be diverted through ozone resistant piping 36 into the vent line 13A then into the destruction unit 37. The 3-way valve 27 in the alternative position may divert the ozone gas to different areas of use, such as water treatment (not shown).

The apparatus optionally includes a steam jacket 48 and a port 49 for manually adding chemicals. A steam line may also be included to maintain water temperature during the process cycle if a higher temperature is required by the wash formula.

The microprocessor 41 provides electronic control of the valves, water, ozone, etc., depending upon the different operation required. For example, the apparatus can be operated to extract, wash, emit steam alone or with the oxidizing gas.

The following chart shows the arrangement of the valves during an ozone decolorization process of wetted garments and during their process 14 steps.

| | Micro-Pro Signal | Valve 17 | Valve 43 | Valve 21 | Valve 18 | Valve 27 |
|---|---|---|---|---|---|---|
| Formula Step: | | | | | | |
| Desize w/o ozone | No Signal | Closed to Apparatus | N/A | Closed | Open | |
| Desize w/ozone | Signal | Open to Apparatus | Open to 15 or 15A | Closed | Closed | N/A |
| Decolorize w/o ozone | No Signal | Closed to Apparatus | N/A | Closed | Open | |
| Decolorize w/ozone | Signal | Open to Apparatus | Open to 15 or 15A | Closed | Closed | N/A |
| Purge-after either ozone step | Signal | Closed to Apparatus | N/A | Open | Open | N/A |

*Valve 27 can be placed to either position without effect on the ozone process during the entire application. Valve 27 controls the ozone to the destruct unit or to elsewhere in the facility.
**Valve 18 in the closed position means closed approximately 87% to still allow for sufficient vacuum by the destruction unit to keep the apparatus from becoming pressurized.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. An apparatus for use with a source of an oxidizing gas for laundering and selectively treating a garment or a fabric with an oxidizing gas alone or in combination with a liquid or steam under pressure, which comprises:

a housing having a chamber, said chamber having an apertured barrel with at least one inlet port mounted for rotation therein, motor means for rotating said barrel;

door means on said housing for placing said garment or fabric in said chamber, said door means having a port at the bottom thereof;

valve means for introducing an oxidizing gas through said port into said chamber;

flow control means for controlling the flow of oxidizing gas and pressure within said chamber means for introducing steam into said chamber;

three way valve means for removing oxidizing gas from said chamber;

a microprocessor for selectively controlling the operation of each of said valve means and flow control means for the introduction of liquid or steam into said chamber and controlling the pressure within said chamber;

whereby said garments can be treated with an oxidizing gas in a dry or wetted state or in a liquid.

2. The apparatus of claim 1 including an oxidizing gas destruction unit associated therewith for destroying exhausted oxidizing gas.

3. The apparatus of claim 1 wherein said barrel is provided on its interior with means for abrading said garment or fabric.

4. The apparatus of claim 1 wherein said means for rotating said barrel comprises a variable motor.

5. The apparatus of claim 1 wherein said means for introducing oxidizing gas is an ozone generator.

6. The apparatus of claim 1 wherein said means for introducing steam into said chamber comprises a steam jet.

7. The apparatus of claim 1 wherein said means for introducing an aqueous liquid into said chamber comprises a water valve.

8. The apparatus of claim 1 including means for monitoring the amount of oxidizing gas in said chamber.

9. The apparatus of claim 1 including means for heating said chamber.

* * * * *